United States Patent [19]

Honda et al.

[11] Patent Number: 5,004,951

[45] Date of Patent: Apr. 2, 1991

[54] SINGLE SIDE-SEALED METAL VAPOR DISCHARGE LAMP

[75] Inventors: Kazuo Honda, Hiratsuka; Atsushi Matsuura, Yokohama; Hisanori Sano, Yokosuka, all of Japan

[73] Assignee: Toshiba Lighting & Technology Corporation, Tokyo, Japan

[21] Appl. No.: 470,681

[22] Filed: Jan. 26, 1990

[30] Foreign Application Priority Data

Jan. 31, 1989 [JP] Japan ..... 1-21054
Mar. 31, 1989 [JP] Japan ..... 1-83647
Mar. 31, 1989 [JP] Japan ..... 1-83652

[51] Int. Cl.[5] ..... H01J 61/00; H01J 61/04

[52] U.S. Cl. ..... 313/631; 313/620; 313/628; 313/633

[58] Field of Search ..... 313/620, 621, 631, 633, 313/317, 328

[56] References Cited

U.S. PATENT DOCUMENTS 4,636,687 1/1987 Keeffe et al. ..... 313/620
4,709,184 11/1987 Keffe et al. ..... 313/633
4,739,220 4/1988 Dobrusskin et al. ..... 313/623
4,782,266 11/1988 Heider et al. ..... 313/621

FOREIGN PATENT DOCUMENTS 50-93785 8/1975 Japan .
52-15910 5/1977 Japan .
56-122259 9/1981 Japan .
0147861 9/1982 Japan ..... 313/631
0230253 12/1984 Japan ..... 313/620
60-232662 11/1985 Japan .
63-148529 6/1988 Japan .
63-148530 6/1988 Japan .

*Primary Examiner*—Donald J. Yusko
*Assistant Examiner*—N. D. Patel
*Attorney, Agent, or Firm*—Cushman, Darby & Cushman

[57] ABSTRACT

A single side-sealed metal vapor discharge lamp is disclosed which includes a discharge tube having a sealed section at one end and a discharge region defining envelope at the other end, a pair of metal foils sealed at the sealed section and a pair of electrodes, the discharge region of the discharge tube containing a rare gas for starting and a filled gas containing mercury and light emitting metal. The electrodes are each comprised of a rod connected to the metal foil and a coil of at least one turn mounted on the forward end portion of a bent end portion of the rod, the coils being oppositely spaced apart by a predetermined distance in the discharge region. The coil is formed of a higher melting point material than a surface material of the forward end portion of the bent portion of the rod. With the length from the bent portion to the forward end of the rod indicated by L1, the length of the coil by L2 and the wire diameter of the coil by d, the following inequalities are satisfied: $L1 \leqq 3d$ and $d/2 \leqq L2 - L1 \leqq 3d$. According to the lamp, it is possible to firmly mount the coil on the corresponding rod, to reduce less scattering of a material of which the electrode is made, to prevent blackening on the tube wall, to obtain a better starting characteristic and to enhance a lumen maintenance factor.

10 Claims, 4 Drawing Sheets

SINGLE SIDE-SEALED METAL VAPOR DISCHARGE LAMP

BACKGROUND OF THE INVENTION

1. Field of the Invention

The present invention relates to a single side-sealed metal vapor discharge lamp and, more particularly, to a small metal halide lamp etc. having a sealed section at a single end only.

2. Description of the Related Art

Recently, a metal vapor discharge lamp also called a high intensity discharge (HID) lamp has increasingly been employed to illuminate the interior of a house, such as a store. A metal halide lamp in particular has widely been adopted to illuminate merchandise in the store, preferably in terms of its high efficacy and its good color rendering properties.

In such indoor illumination installation, it is necessary to make the lamp's size small and the lamp fitting compact.

If, in order to achieve the aforementioned object, a sealed section is to be provided at each end of a discharge tube for a conventional inner arc tube, then more manufacturing steps are required in the formation of the inner arc tube, and the size of the resultant inner arc tube is increased with a size increase in its sealed sections and there is a greater loss of heat coming from the discharge tube.

In order to obtain a compact lamp, it is advantageous to, as disclosed in Japanese Patent Disclosure (KOKAI) 60-232662, form a pinch-sealed section at one end of the discharge tube and a discharge region defining envelope at the other end of the discharge tube to provide a single side-sealed structure.

The single side-sealed type inner arc tube can be made more compact than the inner arc tube whose discharge tube is sealed at both the ends. It is thus possible to decrease a heat loss, because the inner arc tube of interest is of a single side-sealed type, and to improve the light emitting efficiency. Further, it does not take a lot of time to perform a sealing step because the sealed section is of a single type.

In the single side-sealed inner arc tube, a pair of metal foils such as molybdenum foils are sealed in the single side-sealed section and a pair of metal foils are connected to the corresponding pair of electrodes. The electrodes are each composed of a rod connected at one end to the corresponding metal foil and extending at the other end into the discharge region and a coil mounted on the other end portion of the rod. The electrode rod and electrode coil are formed of a tungsten wire or a thoriated tungsten ($ThO_2$-W).

In order to enhance the emission efficiency, the single side-sealed compact metal halide lamp is lighted at a high lamp load satisfying an equation $WL/S=20$ to 70 where WL (watt) and S ($cm^2$) represent the input power of the lamp and the inner surface area, defined in the discharge region, respectively.

Upon the lighting of the lamp at a high load, a metal halide acts upon the electrode rod and, during the life of the lamp, the electrode rod is attacked by the halogen and narrowed down. As a result, tungsten (W) or $ThO_2$-W in the electrode rod is sputtered onto the discharge tube wall, causing blackening on the tube wall and sometimes a breakage of the electrode rod.

If the electrode rod is formed of tungsten (W) or thoriated tungsten ($ThO_2$-W), no better connection can be obtained between the rod and the metal foil because W or $ThO_2$-W is high in the melting point. It takes lots of time in the welding operation.

Under study is the way of preparing an electrode rod made of, a pure rhenium metal or a rhenium/tungsten alloy which are excellent in resistance to halogen and low in the melting point or coating the surface of the electrode rod of tungsten with a pure rhenium metal or a rhenium/tungsten alloy.

If the electrode rod is formed of a pure rhenium metal or a rhenium/tungsten alloy which are excellent in resistance to halogen and low in melting point or the electrode rod made of tungsten is coated with a pure rhenium metal or a rhenium/tungsten alloy, it is desired that the electrode coil be made up of W or $ThO_2$-W. In the case where the electrode coil is formed of a pure rhenium metal or a rhenium/tungsten alloy, since the coil material is lower in melting point than the tungsten in spite of its excellent resistance to halogen, the material of which the electrode coil is made is sputtered from an arc spot onto the discharge tube wall. As a result, blackening on the tube wall progresses for a short period of time, causing a greater fall in lumen maintenance factor. As, in particular, this type of lamp is smaller in the surface area of an inner arc tube, blackening on the tube wall rapidly progresses upon the sputtering of the electrode coil material even if being smaller in quantity, so that the lumen maintenance factor drops to a greater extent.

From this it may be considered that the electrode rod is formed of a pure rhenium metal or a rhenium/tungsten alloy or the tungsten rod is coated with the rhenium metal or the rhenium/tungsten alloy and that the electrode coil is formed of W or $ThO_2$-W.

In the case where the electrode is composed of a rod and a coil, if the forward end of the electrode rod extends from the end of the coil toward the discharge region, an arc spot is generated at the forward end portion of the rod. Since the rod is formed of a pure rhenium metal or a rhenium/tungsten alloy as set out above or the tungsten rod is covered with the pure rhenium metal or a rhenium/tungsten alloy, it melts at a lower temperature level and the material of which the electrode rod is made is scattered onto the tube wall during the life of the lamp, causing blackening on the tube wall. As a result, the lumen maintenance factor is lowered.

If the size of the electrode coil is too large, the heat capacity becomes greater and hence a temperature rise is hard to produce in the electrode coil at a time of starting. As a result, no steady arc is obtained and the startability is lowered.

SUMMARY OF THE INVENTION

It is accordingly the object of the present invention to provide a single side-sealed metal vapor discharge lamp which can firmly mount electrode coils on corresponding electrode rods, can prevent early blackening on the tube wall resulting from the sputtering of the electrode rods to enhance the lumen maintenance factor and can decrease the size of the electrode coils to improve the startability of the lamp.

According to the prevent invention, there is provided a single side-sealed metal vapor discharge lamp which comprises:

an arc tube having a sealed section at one end and an envelope at the other end, the envelope defining a discharge region containing a rare gas for starting and a filled gas containing mercury and light emitting metal;

a pair of metal foils sealed in the sealed section; and a pair of electrodes each comprised of a rod and a coil mounted on a forward end portion of the rod, the rod being inserted at one end into the sealed section and connected to the corresponding metal foil and the other end portions of the rods being bent and situated opposite to each other in the discharge region, and the coils of the electrode being mounted on the bent forward end portions of the rods by at least one turn, situated opposed to each other in the discharge region, and made of a higher melting point material than a surface material of the bent forward end portions of the rod, where the following inequalities are satisfied:

$$L1 \leqq 3d$$

$$d/2 \leqq L2 - L1 \leqq 3d$$

where

L1: the length from the bent portion to the forward end of the electrode rod;

L2: the length of the coil; and d: the wire diameter of the coil.

In the lamp, the electrode coil of at least one turn is wound around the forward end portion of the bent portion of the electrode rod and firmly mounted there. Since $L1 \leqq 3d$, the length L1 from the bent portion to the forward end of the rod is equal to, or less than, three turns of the coil, that is, the length L1 from the bent portion to the forward end of the rod is so restricted as set forth above. For this reason, the size of the wound coil is restricted to a not too large size. It is thus possible to decrease the heat capacity of the electrode and to improve the startability of the lamp. Since $d/2 \leqq L2 - L1$, the forward end of the rod is retracted by at least d/2 from the end of the coul, that is, from the "discharge region" side. It is possible to prevent an arc spot from occuring on the forward end of the rod which melts at a low temperature level. It is possible to prevent blackening on the tube wall resulting from the sputtering of the rod material onto the tube wall which would otherwise occur in the conventional lamp, and to prevent a decline in the lumen maintenance factor. Since $L2 - L1 \leqq 3d$, the extent to which the coil projects from the forward end of the rod is restricted. It is possible to set the electrode-to-electrode distance above a given dimension in spite of a small discharge region.

DETAILED DESCRIPTION OF THE PREFERRED EMBODIMENT

Figure 1:
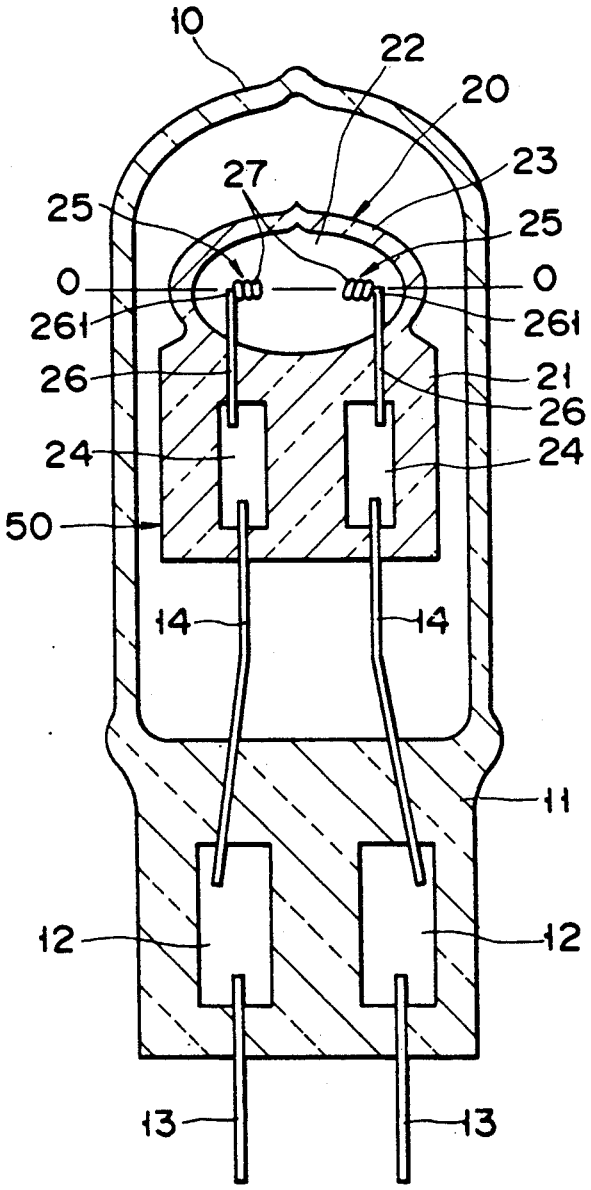
FIG. 1 shows a vertical cross-section of a single side-sealed metal halide lamp according to a first embodiment of the present invention.

FIG. 1 shows a 150 W-input power metal halide lamp. In FIG. 1, reference numeral 10 denotes an outer tube made of quartz glass and containing an inner arc tube 50.

The outer tube 10 has a pinch-sealed section 11 formed at one end where metal foils 12, 12 made of Mo are sealed. Outer lead-in wires 13 and 13 are connected to the metal foils 12 and 12, respectively, and inner lead-in wires 14 and 14 for support are connected to the metal foil 12 and 12, respectively. The inner lead-in wires 14 and 14 serve as support wires and outer lead-in wires for an inner arc tube 50.

A base, not shown, is covered on the sealed section 11 of the outer tube 10.

The inner arc tube 50 contains the discharge tube 20 made of quartz glass which is of the same single side-sealed type as that of the outer tube 10.

At one end only, the discharge tube 20 has the sealed section 21 and, at the other end, an envelope 23 for defining the discharge region 22. The envelope 23 is so formed as to have an elliptical or a circular shape as viewed from an observation angle and hence to have a nearly ellipsoidal shape. The envelope 23 has an inner volume of about 0.5 cc as a discharge region with its elliptical major axis lying on the bulb axis 0—0. The discharge tube 20 has a sealed section 21 at one end such that it is located in a direction orthogonal to the bulb axis 0—0. The sealed section 21 is pinched to provide a flat type sealed section.

A pair of electrodes 25, 25 are mounted in the discharge tube 20 in a manner spaced apart on the bulb axis 0—0.

The electrodes 25 and 25 are connected to metal foils 24 and 24 which are sealed at the single side-sealed section 21 and which are made of molybdenum (Mo). Inner lead-in wires 14, 14 of the outer tube 10 are connected to the metal foils 24 and 24, respectively.

Figure 2:
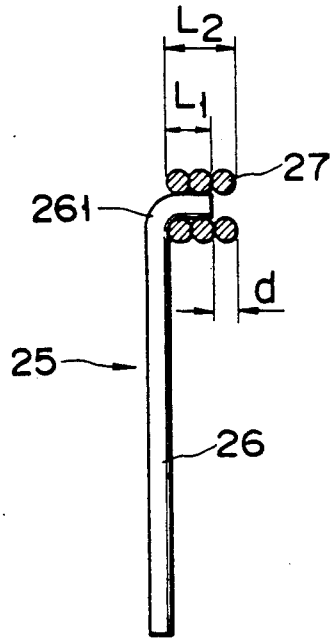
FIG. 2 is a cross-sectional view showing a detailed structure of an electrode in FIG. 1.

As shown in FIG. 2, the electrodes 25 and 25 each comprise an electrode rod 26 and electrode coil 27 formed separate from the electrode rod 26 and turned on the rod 26.

The rod 26 is formed of a pure rhenium wire, or a rhenium/tungsten alloy wire, 0.5 mm in diameter or a tungsten wire covered with a pure rhenium or a rhenium/tungsten alloy 0.5 mm in diameter. The rod 26 is connected to the metal foil 24 at the sealed section 21. The rods 26 have mutually bent sections 261 partway of their forward end portions extending into the discharge region 22.

The coil 27 is formed by turning a tungsten or thoriated tungsten wire (a wire containing about 2% of $ThO_2$ against W) of a diameter d, as about 3 to 4 turns for instance of a coil 0.5 mm in diameter, on the rod 26.

In this way, the coil 27 has at least one turn on the rod end portion forwardly of the bent portion 261 of the rod 26.

Let it be assumed that the length from the bent portion 261 to the forward end of the rod is L1; the length of the coil 27, L2; and the wire diameter of the coil 27, d. In this case, $$L1 \leqq 3d \quad (1)$$

$$d/2 \leqq L2 - L1 \leqq 3d \quad (2).$$

In the present embodiment, the diameter d of the coil is 0.5 mm; the length L1 from the bent portion 261 to the forward end of the rod is 1.0 mm; and the length L2 of the coil is 1.5 mm.

A electrode-to-electrode distance, that is the length from the coil 27 to the opposite coil 27 on the axis 0—0 of the envelope, is set to be 6.8 mm.

The bulb contains a gas for starting, which contains a predetermined amount of mercury and at least one kind of a metal halide selected from the group consisting of $SnI_2$, NaI, TlI, InI, NaBr and LiBr, in a sealed fashion.

In the single side-sealed metal halide lamp, the lamp current I at a time of steady lighting is 1.8 A and the lamp input power W is set to 150 W.

The inner surface S of the discharge region 22 is 3.5 $cm^2$ and the lamp load per unit area of the arc tube 20 is about 43 $W/cm^2$.

The function of the small metal halide lamp thus constructed will be explained below.

Since the electrode 25 is each composed of the rod 26 made of the pure rhenium or rhenium/tungsten alloy wire or the tungsten wire coated with the pure rhenium or rhenium/tungsten alloy, the lamp has a high halogen-resistant characteristic and can suppress a temperature rise in the rod 26 during lighting and prevent a breakage resulting from the narrowing of the rod 26, assuring a longer service life.

As the rod 26 is made lower in melting point than that of tungsten, a better bond can be achieved upon the burial of the metal foils 24 and 24, ensuring an easier welding operation.

An the other hand, the coil 27 is formed of the tungsten or the thoriated tungsten wire and there is less possibility that the material of which the coil is made will be sputtered because of its ready electron emission and its melting point. It is thus possible to prevent "blackening" caused by the sputtered material on the tube wall.

The reason is that the electrodes 25, 25 are composed of electrode rods 26 and coils 27 different in material from the electrode rods.

Let it be assumed that, in the aforementioned structure, the length from the bent portion 261 to the forward end of the rod 26 is L1, the length of the electrode coils, L2 and the wire diameter of the coil, d. In this state, $$L1 \leqq 3d \quad (1)$$

$$d/2 \leqq L2 - L1 \leqq 3d \quad (2),$$

offering the following advantages.

That is, the coil 27 is provided with at least one turn coiled from the bent portion 261 to the forward end of the rod 26, and the coil 27 can take up a predetermined contact area relative to the rod 26, maintaining a mechanical strength higher than a given level. There is no risk that the coil 27 will drop out of the rod 26 even if a vibration or shock is transmitted to the coil 27.

Since $d/2 \leqq L2 - L1$, over the length from the forward end to the bent portion 261 of the rod 26, the coil is retracted by at least half coil wire diameter (d/2) from the forward end face of the coil 27, that is from the discharge region side, toward the inside of the coil 27, thus preventing occurrence of an arc spot at the forward end of the rod 26 made of a lower melting point material. It is thus possible to prevent sputtering of the rod material on the tube wall and to prevent a fall in a lumen maintenance factor resulting from the occurrence of the blackening on the tube wall.

Further, since $L1 \leqq 3d$, the length L1 from the bent portion 261 toward the forward end face of the rod 26 is not too large. As a result, the number of the turns of the coil 27 is restricted and hence the coil 27 is not too large while, on the other hand, the temperature of the coil 27 is rapidly raised because the heat capacity of the coil 27 is suppressed to a smaller extent. A better startability result.

Since $L2 - L1 \leqq 3d$, the extent to which the coil 26 extends from the forward end of the rod is dimensionally restricted. The electrode-to-electrode distance can be made larger than a predetermined dimension in spite of the smaller discharge region, ensuring a steady discharge.

A second embodiment of the present invention will be explained below with reference to FIG. 3.

The second embodiment of the present invention is different from the first embodiment in that a pair of electrode rods 26, 26 are spaced away from each other in a sealed fashion and that quartz tubes 30 and 30 are covered on the base portions of the rods 26 and 26, respectively.

Stated in more detail, this type of lamp is made compact because a pinch-sealed portion 21 of an arc tube 20 is made narrower than that of the previous embodiment in its width direction. For this reason, a pair of metal foils 24 and 24 which are sealed in the sealed section 21 cannot be so set as to leave a greater spatial distance relative g to each other.

Figure 3:
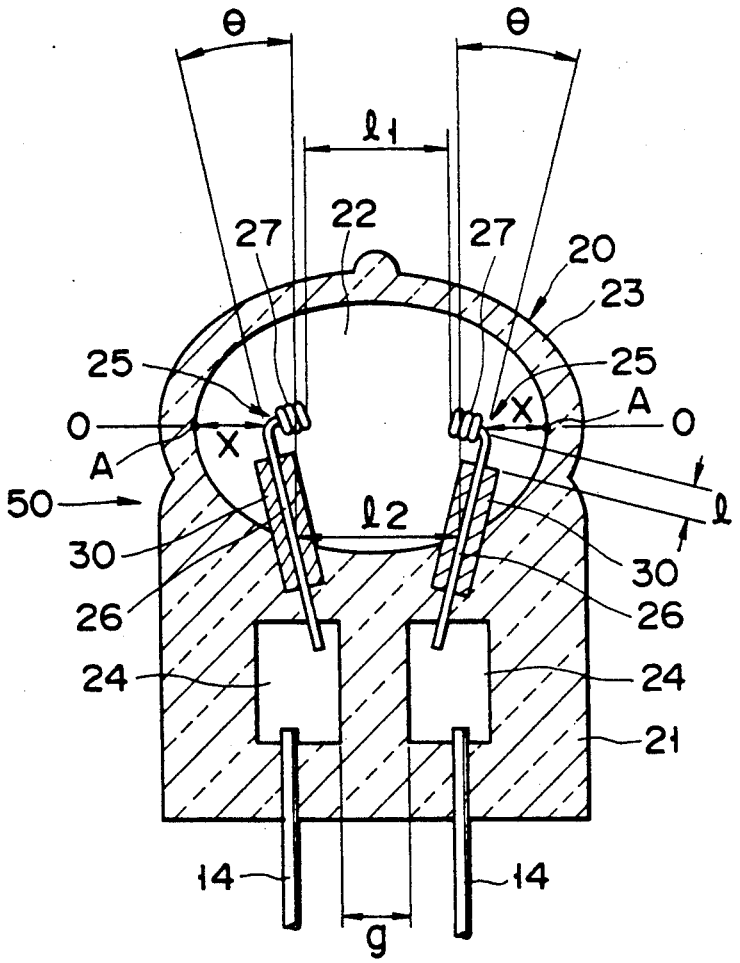
FIG. 3 shows a vertical cross-section of an arc tube for a second embodiment of the present invention.

In such a lamp, the coolest zone is created at those portions indicated by A in FIG. 3, that is, at those portions of the tube wall which are situated opposite the backs of the coils 27 and 27 of the electrode 25 and 25. If a spatial distance x between the coolest zone A of the tube 20 and the electrodes 25, 25 is made smaller, it is possible to raise the temperature at the coolest zone A and to enhance the emission efficiency and color rendering properties.

The electrode rods 26, 26 connected to metal foils 24, 24 may be diagonally located at an angle $\theta$ to a line perpendicular to the 0—0 axis so that their forward ends are spaced apart to a greater extent.

Since the forward ends of the rods 26, 26 are spaced apart in such a way as set forth above, the distance l2 between the base end portions of the rods 26, 26 which are sealed at the pinch-sealed section 21 becomes nearer to the distance l1 between the forward ends of the coils 27 and 27, that is the electrode-to-electrode distance. In an extreme case, the spatial distance l2 between the sealed end portions of the rods 26 and 26 will become shorter than the distance l1 between the forward ends of the coils 27 and 27, that is $l1 \geqq l2$. In the structure shown in FIG. 3, the distance l1 between the forward end of the coils 27 and 27 is shown as being yet greater than the length l2 between the sealed end portions of the rods 26 and 26.

In such case, no discharge will occur between the coils 27 and 27 of greater heat capacity and a discharge will occur between those base end portions of the rods 26 and 26 which are relatively narrower in their spatial distance.

In the present embodiment, however, quartz tubes 30 and 30 are fitted over the sealed end portions of the rods at a location of the pinch-sealed section 21.

The quartz tubes 30 and 30, together with the rods 26 and 26, are buried at their base end portions into the pinch-sealed section 21 with the forward end portions of the rods 26, 26 left exposed by a predetermined length l (mm) relative to the forward end portions of the quartz tubes. That is, the quartz tubes 30 and 30 leave exposed rod areas of predetermined length l (mm) between the bent portions of the rods 26 and 26 and the adjacent areas covered with the quartz tubes.

The quartz tubes 30 and 30 have a thickness t (mm) of $0.2 \leqq t \leqq 1.5$ and the length l (mm) of the rod from the forward end of the quartz tube to the bent portion 261 is $l \leqq 4.5$.

The operation of the second embodiment will be explained below.

Since the forward ends of the opposite electrode rods 26 and 26 are spaced apart to a greater extent, the bent portions of the electrode rod 26 can be located closer to the tube wall so that it is possible to decrease a spatial distance x between the bent spot of the rod and the tube wall. This specific arrangement allows ready heat transfer from the coils 26, 26 to the wall of the tube 20 and hence a temperature rise at the coolest zone A. It is thus possible to improve the emission efficiency and color rendering properties.

It is not necessary to increase the spatial distance g between the two metal foils 24 and 24. The aforementioned structure can reduce the width of the pinch-sealed section 21.

As the quartz tubes 30 and 30 are fitted over the base end portions of the rods 27, 27 buried in the pinch-sealed section 21, a discharge across the base end portions of the rods 27, 27 can be prevented even if the distance l2 between the base end portions of the rods 27, 27 becomes nearer to that between the other portions of the rods 27, 27 or shorter than that between the other portions of the rods 27, 27.

As a result, the rods 26, 26 are prevented from being broken and, further, it is possible to prevent cracks due to an overheating involved there, thus extending the service life of the lamp.

Since $0.2 \leqq t \leqq 1.5$ where t denotes the thickness (mm) of the quartz tubes 30, 30, the following advantages are obtained according to the present invention.

That is, at $t < 0.2$ mm, cracks occur at the quartz tubes 30, 30 due to a thermal shock during lighting of the lamp. If the quartz tubes 30, 30 are gradually narrowed down, a breakage occurs as the quartz tubes 30, 30 as the end of the service life is nearer. For this reason, a discharge occurs across the rods.

At $t > 1.5$ mm, it is difficult to seal the quartz tubes at the pinch-sealed section 21 or it is impossible to obtain a complete seal of the quartz tubes at the pinch-sealed section 21. Leakage sometimes occurs at the pinch-sealed section 21 during the lifetime of the lamp.

Since the length l (mm) from the ends of the quartz tubes 30, 30 to the bent portions of the rod, that is the length l (mm) of the exposed rod area between the bent portions of the rods and the forward ends of the quartz tubes is set to be $l \leqq 4.5$, the exposed rod areas of the discharge rods at a location of the shortest distance become sufficiently greater than the coil-to-coil distance l1, thus preventing occurrence of a discharge across the rods 26 and 26.

Table 1 below shows the result of experiments conducted in connection with the second embodiment of the present invention.

TABLE 1

| exposed area length of electrode rod l (mm) | thickness of quartz tube t (mm) | probability of discharge occurring between discharge rods (%) early stage of life (100 hours) | later stage of life (6000 hours) | result of test |
|---|---|---|---|---|
| 2.5 | 0.1 | 0 | 5 | bad |
| 3.5 | 0.1 | 0 | 15 | bad |
| 4.5 | 0.1 | 0 | 32 | bad |
| 5.5 | 0.1 | 20 | — | bad |
| 2.5 | 0.15 | 0 | 2 | bad |
| 3.5 | 0.15 | 0 | 5 | bad |
| 4.5 | 0.15 | 0 | 10 | bad |
| 5.5 | 0.15 | 20 | — | bad |
| 2.5 | 0.2 | 0 | 0 | good |
| 3.5 | 0.2 | 0 | 0 | good |
| 4.5 | 0.2 | 0 | 0 | good |
| 5.5 | 0.2 | 20 | — | bad |
| 2.5 | 0.25 | 0 | 0 | good |
| 3.5 | 0.25 | 0 | 0 | good |
| 4.5 | 0.25 | 0 | 0 | good |
| 5.5 | 0.25 | 20 | — | bad |

The aforementioned tests are conducted for 150W-type metal halide lamps having the same dimensions as in the embodiment shown in FIG. 1.

As will be appreciated from the results of the test, a discharge occurring across the electrode rods at an earlier stage of life of the arc tubes has some relevancy to the exposed area length l of the discharge rods. For a range of $l \leqq 4.5$, the quartz tube 30 covers the rod 26 up to a relatively high position and the rods are spaced apart to a greater extent at a location of their exposed area length, preventing the generation of a discharge. At the later stage of life of the arc tube, a discharge has some relevancy rather to the thickness t of the quartz tubes 30. At $t < 0.2$, cracks occur in the quartz tube and a breakage occurs due to an involved corrosion in the quartz tube. At the later stage of life of the lamp, a discharge occurs across the rods. At $t > 1.5$, it is difficult to obtain a sealing. This causes a leakage.

At $0.2 \leqq t \leqq 1.5$, it is better to control the exposed area length l of the rod in a range of $l \leqq 4.5$. Various conditions being equal, more preferable range is $0.4 \leqq t \leqq 1.0$ in which case it is better to control the aforementioned length l within a range of $1 \leqq l \leqq 4$.

A third embodiment of the present invention will be explained below in connection with FIGS. 4 and 5.

The third embodiment is different from the first embodiment in that a variant of a pinch-sealed section has been adopted. That is, in order to obtain a compact arc tube it is advantageous to adopt a single side-sealed structure. If, however, a heat loss from the sealed section is reduced, a temperature rise is produced at the coolest zone. It is thus possible to increase a vapor pressure of a light emitting metal and to enhance the emission efficiency. It is desired that the surface area of the sealed section be made as small as possible.

Figure 5:
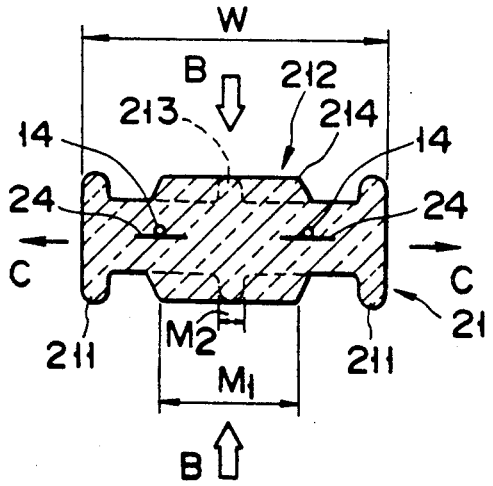
FIG. 5 is a cross-sectional view, as taken along line V—V in FIG. 4.

In the present embodiment, the pinch-sealed section 21 is shown in cross section in FIG. 5. The pinch-sealed section 21 has thick-walled portions 211, 211 at both the sides in its width direction and a thick-walled portion 212 as a central area located between the thick-walled portions 211 and 211.

The central thick-walled portion 212 has a criss-cross shape as viewed from a front view. That is, the central thick-walled section 212 is of a criss-cross configuration with a thick-walled section 213 in a vertical direction and a thick-walled section 214 in a horizontal (width) direction. The horizontal length M1 of the central thick-walled section 212 as viewed in the vertical direction is maximal and the horizontal length M2 of the thick-walled section 212 as viewed in the vertical direction except for the horizontal length M1 of the central thick-walled section 212 is set to be smaller than the horizontal length M1.

In the case where a pinch-sealed section is to be normally formed at the end of the arc tube, the end portion of a glass tube is softened upon heating by a burner flame and pushed in a direction of an arrow B to provide a pinch-sealed section. In this case, the softened glass mass flows in a direction of an arrow C perpendicular to the pushing direction so that the width W of the sealed section is increased, that is, the sealed section becomes greater.

In this case, a pair of metal foil, such as molybdenum foil are flowed in the direction of the arrow C to provide a sealed end section with the metal foils spaced apart to a corresponding extent (a distance g).

When the side walls of an open end portion of the discharge tube are thermally softened, the softened glass tube has the property of being most shrunk at the fullest burnt portion and a glass spot heated by a burner flame is diameter-shrinked to provide a pool in a molten glass. Upon the pushing of the thickened wall portions by the flat surface of a pushing jig in the direction of the arrows B, B, the molten mass of the tube flows in a left/right direction as indicated by arrows C. As this time, an amount of molten mass transfer at the center as viewed in a vertical direction in FIG. 4 becomes greater than an amount of molten mass transfer above and below the central mass to provide different amount of molten mass transfer as viewed in the vertical direction.

By so doing, the metal foils are pushed more at the central area than at the area other than the central area and a bending force is created at the left and right metal foils, offering a possibility of a foil breakage.

Figure 4:
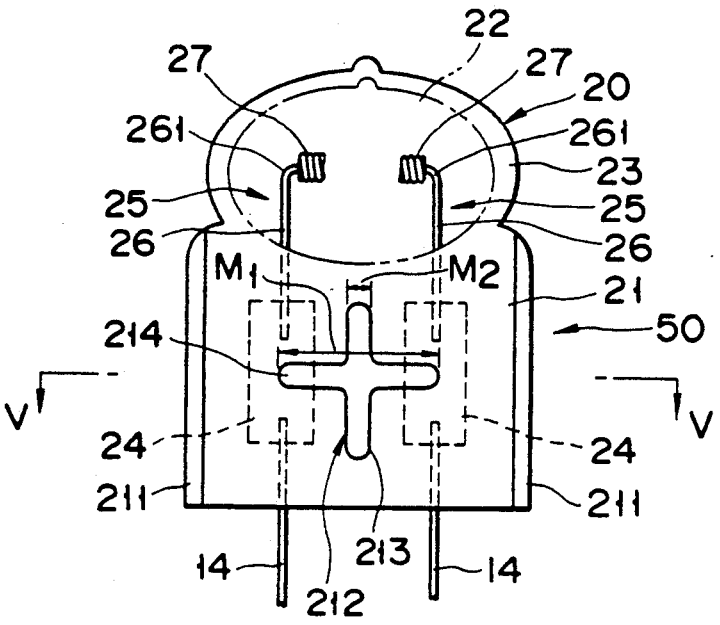
FIG. 4 is a front view of an arc tube for a third embodiment of the present invention.

According to the embodiment shown in FIGS. 4 and 5, a pair of thick-walled portions 211, 211 are formed one at each side of the sealed section 21 with a thick-walled portion 212 formed at a central area, making it possible to reduce the width W of the sealed section 21.

Further, the molten mass of the softened sealing section 21 flows toward each side of it and toward the central area of it. The pair of metal foils 24, 24 are less displaced across the width of the section 21, preventing the broadening of a distance across coils 27, 27 of the electrodes 25, 25.

The sealed section has the maximal length M1 at the central area as viewed in the vertical direction and the length M2 at the areas below and above the area corresponding to the maximum length M1, noting that the length M2 is set to be smaller than the length M1. Even if the softened mass is pushed by the pushing jig at a sealing step in the direction of arrows B, B, it entails less molten mass transfer, exerting less bending force upon the metal foils 24, 24 at both the sides of the sealing section. It is thus possible to prevent a foil breakage.

A fourth embodiment of the present invention will be explained below with reference to FIG. 6.

The fourth embodiment is different from the third embodiment in that a thick-walled area of a different shape is formed at a central area of a sealed section 21.

Figure 6:
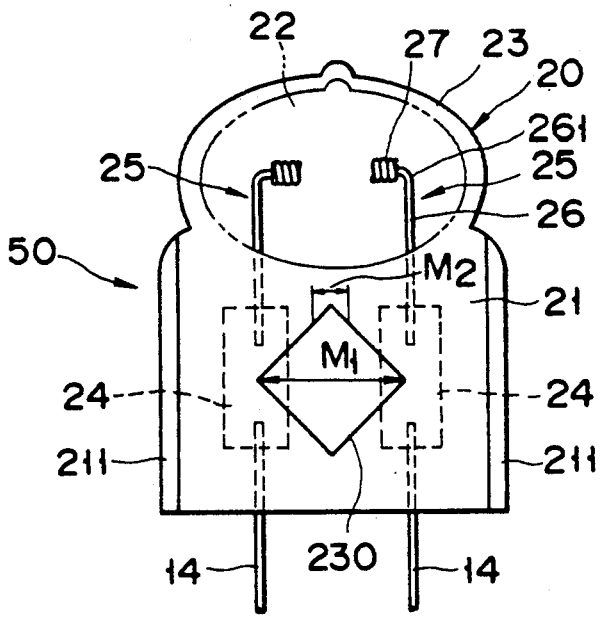
FIG. 6 is a front view of an arc tube for a fourth embodiment of the present invention.

That is, the fourth embodiment shown in FIG. 6 includes a diamond-shaped area, at a central thick-walled area 230, in that sealed section 21. Even in this embodiment, the length M1 is maximal at a central area of the sealed section 21 as viewed in a vertical direction in FIG. 6 and the length M2 at those areas above and below the central area corresponding to the maximal length M1 is set to be smaller than the length M1 (M1>M2). It is, therefore, possible to prevent a molten mass transfer and hence a foil breakage.

Figure 7:
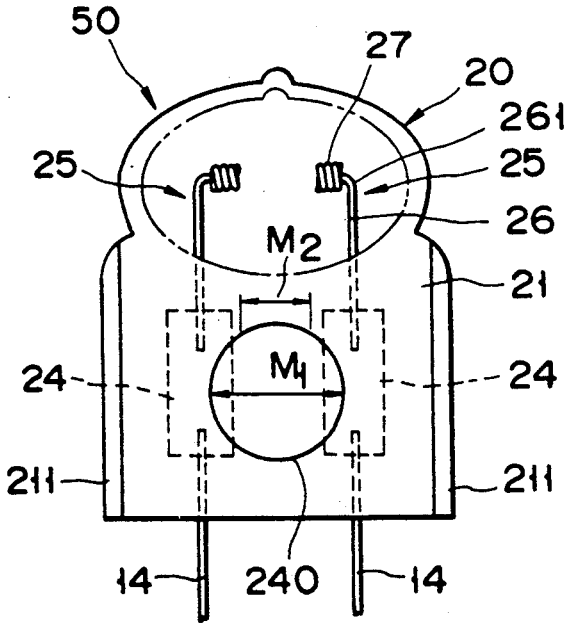
FIG. 7 is a front view of an arc tube for a fifth embodiment of the present invention.

A fifth embodiment of the present invention will be explained below with reference to FIG. 7.

In the fifth embodiment, a pinch-sealed section has a central thick-walled area of a circular shape. The central thick-walled area of the sealed section has a maximal length M1 at the central area as viewed in a vertical direction and a length M2 at those areas above and below the central area corresponding to the maximal length M1, noting that the length M2 is set to be smaller than the length M1 (M1>M2). It is possible, even in this case, to prevent the transfer of a pool of molten mass and hence a foil breakage.

The present invention is not restricted to the metal halide lamp. For example, other metal vapor discharge lamp such as a high-pressure mercury lamp may be used if the lamp is of such a type as to have a pinch-sealed section at one end.

What is claimed is:

1. A single side-sealed metal vapor discharge lamp comprising:

an arc tube having a sealed section at one end and an envelope at the other end, the envelope defining a discharge region containing a rare gas for starting and a filled gas containing mercury and light emitting metal;

a pair of metal foils sealed in the sealed section; and a pair of electrode means each comprised of a rod and a coil mounted on a forward end portion of the rod, the rod being inserted at one end into the sealed section and connected to the corresponding metal foil and the other end portions of the rods being bent and situated opposite to each other in the discharge region, and the coils of the electrode means being mounted on the bent forward end portions of the rods by at least one turn, situated, opposed to each other in the discharge region, and made of a higer melting point material than a surface material of the bent forward end portions of the rods, where the following inequalities are satisfied:

$$L1 \leqq 3d$$

$$d/2 \leqq L2 - L1 \leqq 3d$$

where

L1: the length from the bent portion to the forward end of the electrode rod;

L2: the length of the coil; and d: the wire diameter of the coil.

2. The lamp according to claim 1, wherein said lamp is lighted in a WL/S range satisfying an inequality given below:

$$20 \leqq WL/S \leqq 70$$

where

S(cm$^2$): an inner surface area defined in said discharge region; and

WL: a rated lamp input power (Watt).

3. The lamp according to claim 1, wherein said rod has a surface formed of at least a pure rhenium metal or a rhenium/tungsten alloy.

4. The lamp according to claim 1, wherein said rod is wholly made of a pure rhenium or rhenium/tungsten alloy.

5. The lamp according to claim 1, wherein said light emitting metal is an iodide and/or a bromide of Sn and/or Na.

6. The lamp according to claim 1, wherein said light emitting metal is an iodide and/or a bromide of Sn and/or Na, and one metal selected from the group consisting of Tl, In and Li.

7. The lamp according to claim 1, wherein said rods are spaced apart by a greater extent at their bent portions than at their base end portions, the bent portions of the rods being situated closer to an inner surface of said envelope.

8. The lamp according to claim 1, wherein a quartz tube is fitted over the base end portion of said rods.

9. The lamp according to claim 8, wherein a thickness t (mm) of said quartz tube satisfies an inequality:

$$0.2 \leqq t \leqq 1.5.$$

10. The lamp according to claim 8, wherein a distance l (mm) from a forward end of said quartz tube to a bent portion of said rod is $l \leqq 4.5$.

* * * * *